United States Patent [19]

Veldman

[11] 4,269,464

[45] May 26, 1981

[54] TILTING TERMINAL CLAMP

[75] Inventor: Donald R. Veldman, Oak Lawn, Ill.

[73] Assignee: Howard S. Langdon, River Forest, Ill.

[21] Appl. No.: 61,656

[22] Filed: Jul. 30, 1979

[51] Int. Cl.[3] ..... H01R 4/44

[52] U.S. Cl. ..... 339/95 R; 339/246

[58] Field of Search ..... 339/246, 263, 95 R

[56] References Cited

U.S. PATENT DOCUMENTS

| | | | |
|---|---|---|---|
| 3,372,366 | 3/1968 | Cochrum | 339/246 |
| 3,398,393 | 8/1968 | Cochrum | 339/246 |
| 3,891,296 | 6/1975 | Gutshall | 339/246 |
| 3,993,397 | 11/1976 | Gutshall | 339/246 |
| 4,097,112 | 6/1978 | Veldman et al. | 339/246 |
| 4,135,777 | 1/1979 | Barth | 339/246 |

FOREIGN PATENT DOCUMENTS

| | | | |
|---|---|---|---|
| 2162523 | 6/1973 | Fed. Rep. of Germany | 339/246 |

*Primary Examiner*—John McQuade

*Attorney, Agent, or Firm*—Tilton, Fallon, Lungmus & Chestnut

[57] ABSTRACT

A tilting terminal clamp including a threaded shank extending from a head end, an integral annular plate retaining ring spaced below the head and a plate having a frusto conical annulus about the shank aperture to provide a concave surface confronting the annular ring with the annulus being sized and shaped to substantially receive the annular ring.

3 Claims, 7 Drawing Figures

TILTING TERMINAL CLAMP

BACKGROUND AND SUMMARY OF INVENTION

This invention relates to a tilting terminal clamp and, more particularly to a clamp for securing wires within terminal body pockets such as are widely used in the electrical and electronic industries.

In the past, tiltability has been provided by a conical ramp either on the underside of the screw head or the top of the clamping plate. Exemplary of the former is Pat. No. 4,097,112 and of the latter is U.S. Pat. No. 3,891,296. In either construction, the conical ramp provides an advantageous bearing when the clamping plate is tilted to accommodate a wire as is shown in U.S. Pat. No. 4,097,112.

Notwithstanding the large amount of work that has gone into tilting terminal clamps, there has persisted for many years the problem of inadvertent detachment of the shank-providing screw from the terminal during shipment where the assembly necessarily encounters bumps, jerks, and other disassembling forces. Even further, the prior art clamps have been inadequate for clamping small diameter wires because the very size of annular ring needed to keep the plate in place on the screw shank has restricted the degree to which the plate can apply clamping action. Thus, the prior art clamps have been inadequate both prior to and during use.

The instant invention solves this problem in a novel way by placing the frusto conical ramp on the clamping plate but at the same time shaping the ramp to receive the confining annular ring within the concave undersurface of the plate. This brings about not only the ramp function provided by the upper surface of the clamping plate but brings about the unexpected advantage of being able to clamp the clamping plate firmly to the terminal within the pocket during shipment, thereby avoiding the undesirable detachment and possible loss of the tilting terminal clamp and further makes possible the clamping of small diameter wires during use.

DETAILED DESCRIPTION

The invention is described in conjunction with the accompanying drawing in which FIG. 1 is a fragmentary elevational view, partially in section and partially broken away of the inventive assembly as it would occur during shipment;

Figure 1:
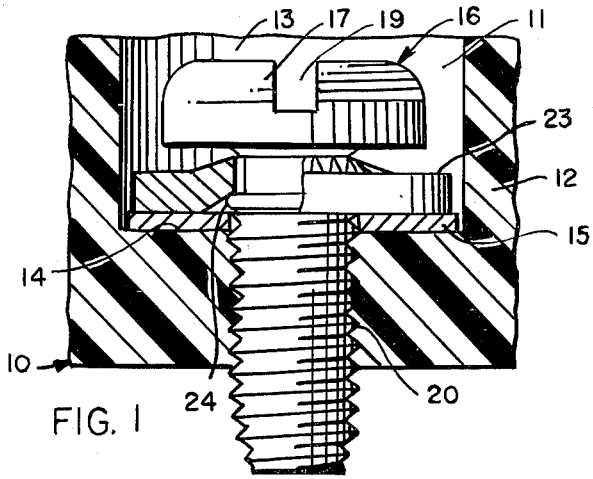

Referring to FIG. 1, a portion of a terminal body 10 which is employed for securing electrical connections is equipped with a pocket 11 defined by sidewalls 12, an end wall 13 and a bottom wall 14. One end wall (or both) is omitted to permit the introduction of a wire lead in the fashion depicted in U.S. Pat. No. 4,097,112.

Reference may be made to that patent for details of construction not illustrated here. The bottom wall is equipped with a plate-like terminal 15 against which wire leads W and W′ may be clamped by means of a tilting terminal clamp generally designated 16.

Figure 2:
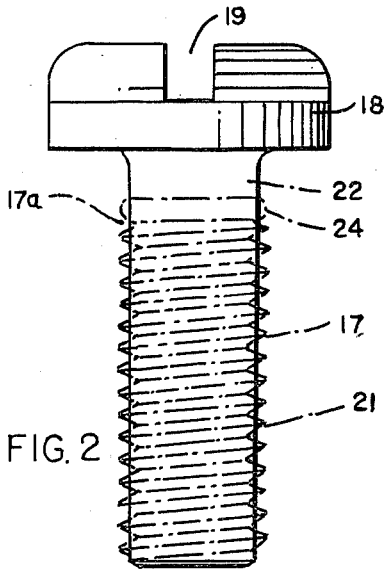
FIG. 2 is an elevational view of the screw part of the clamp before assembly but with the annular ring and threads shown in dotted line.

The clamp 16 includes a screw 17 (see also FIG. 2) which, at its upper end, is equipped with a head 18 suitably slotted or otherwise configured as at 19 to cooperate with a tool for rotating the shank into and out of the threaded aperture 20 provided within the body 10. The major portion of the screw 17 is threaded as at 21 with the threads terminating as at 17*a* to provide unthreaded space as at 22 below the head 18.

Within this space 22 is mounted the clamping plate part 23 and is confined in place by means of an annular ring 24 provided at the upper end of the threaded portion 21 of the screw 17.

In the manufacture generally of the tilting terminal, the screw 17 is provided in the form of a blank, i.e., without the threads 21 and the annular ring 24. At this juncture, the clamping plate 23 which is equipped with a central aperture 25, is ensleeved on the unthreaded blank after which the threads 21 and annular ring 24 are rolled on, thereby permanently confining the clamping plate 23 within the space 22.

Figure 3:
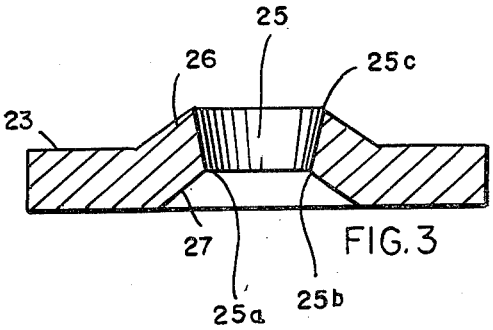
FIG. 3 is a sectional view of the clamping plate.
Figure 7:
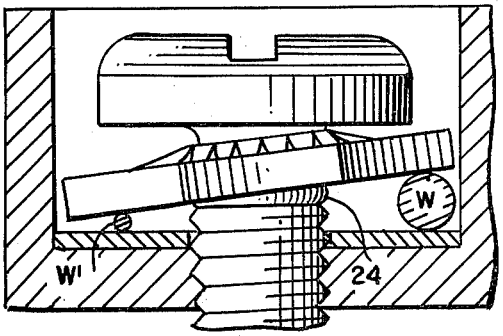
FIG. 7 is a view similar to FIG. 1 but showing the inventive clamp in operating condition, i.e., clamping wire leads.

According to the invention, the clamping plate 23 is equipped with a frusto conical annulus as at 26 (compare FIGS. 3 and 4) which, on its upper surface, provides a ramp of the type previously known for cooperating with the screw 17 to achieve the necessary contact therebetween for clamping two wires of different diameter. On the underside, however, is provided a concave surface 27 which is sized and shaped to substantially receive the annular ring 24 in the fashion depicted in FIG. 1. This then permits the clamping plate 23 to bear tightly against the terminal 15 during shipment and thus avoids the possibility of inadvertent loss of the entire clamp assembly 17. Also, as seen in FIG. 7, the concave undersurface of the plate 23 permits receipt of the annular ring 24 so as to be able to clamp a wire W′ which has a diameter smaller than the height of the annular ring.

Figure 4:
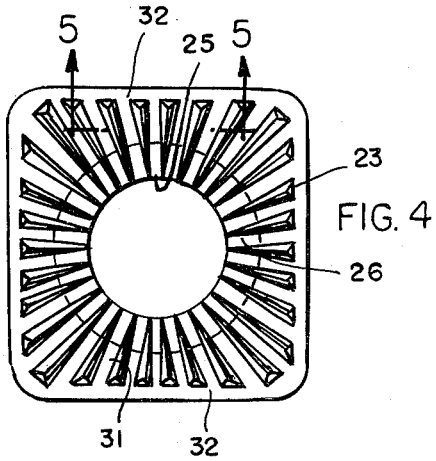
FIG. 4 is a top plan view of the clamping plate of FIG. 3.
Figure 5:
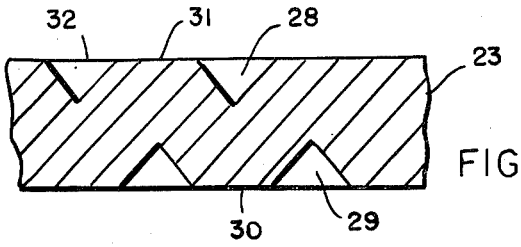
FIG. 5 is a fragmentary sectional view such as would be seen along the sight line 5—5 applied to FIG. 4.

The upper and lower surfaces of the clamping plate 23 may be advantageously serrated as in FIGS. 4 and 5 as at 28 and 29, respectively. The serrations 28 and 29 are generally radial and include flat surfaces 30 and 31 which on one surface are positioned opposite to the vertex parts of the serrations on the other surface. The serrations here provided develop the strong clamping action previously described in connection with U.S. Pat. No. 4,097,112. However, in addition, I provide an unserrated border as at 32 which optimally should be of the same width as the greatest width of the flat surfaces 30 or 31—it being appreciated that the width of the serration flats increases as one proceeds outwardly from the central aperture 25. This border 32 is advantageous in providing a cross clamping action on the wire lead—as contrasted to an angular clamping action provided by the serrations and flats.

It will be appreciated that in certain instances the upper serrations 28 may be omitted inasmuch as they provide no clamping function.

Figure 6:
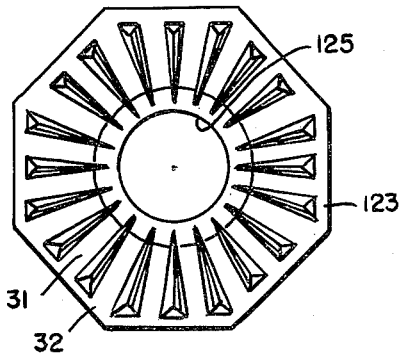
FIG. 6 is a top plan view of a modified form of clamping plate also advantageously employed in the practice of the invention.

The invention can be advantageously used in conjunction with a variety of clamping plates such as the one depicted in FIG. 6 and designated 123. Further details of the construction and operation of the clamping plate 123 can be found in Patent 4,097,112.

Irrespective of the peripheral shape of the clamping plate 23 or 123, the plates are developed similarly. A blank such as a square or octagonal washer is provided with a central aperture as at 25 or 125 afterwhich the washer blank is serrated and then stamped to simultaneously provide the convex upper surface, i.e., the ramp 26 and the concave under surface as at 27 in FIG. 3.

The inventive clamp also makes possible the achievement of greater tilt with the same size opening as prior flat clamping plates or closer fits with the screw while achieving the same degree of tilt. This can be appreciated best from a consideration of FIG. 3 wherein the "flare" of the aperture 25 permits bearing against the screw at the bottom edge—as at 25*a* and 25*b*. With the conventional flat plate bearing would occur at 25*a* and 25*c*, thus limiting the degree of tilt.

While in the foregoing specification a detailed description of the invention has been set down for the purpose of illustration, many variations in the details hereingiven may be made by those skilled in the art without departing from the spirit and scope of the invention.

I claim:

1. A tilting terminal clamp comprising an elongated shank having a slotted head at one end and a lead point at the other end, said shank being equipped with threads extending from said lead point toward said head but terminating in an annular ring a spaced distance from said head, a clamping plate substantially centrally apertured to loosely and tiltably receive said shank and mounted on said shank between said head and said annular ring, said plate being equipped with an integral frusto-conical annulus about said aperture projecting toward said head and presenting a concave surface confronting said annular ring, said annulus being sized and shaped to substantially receive said ring, said plate having a lower serrated surface, the serrations being generally radial and including flats therebetween, said serrations flaring in width as they proceed outwardly from the central aperture of said plate and said serrations terminating short of the periphery of said clamping plate to provide a flat border.

2. The structure of claim 1 in which said border has a width measured in the plane of said flats approximately the same as the maximum width of said flats.

3. A tilting terminal clamp assembly comprising a standard terminal body equipped with a wire receiving pocket having opposed generally parallel sidewalls and an end wall all upstanding from a terminal plate, said terminal body being equipped with a threaded aperture for the receipt of the shank of a terminal clamp screw, said pocket being open at the top thereof for receipt of said terminal clamp and at one end thereof for receipt of said wire, a terminal clamp including a screw having a threaded shank integral with a head for rotating said shank, said shank being equipped with an annular ring a spaced distance from said head, said shank being threadably received in said threaded aperture, a clamping plate centrally apertured and tiltably mounted on said shank between said head and annular ring, said clamping plate being equipped with an integral frusto conical annulus about its aperture projecting toward said head and presenting a concave surface confronting said annular ring, said annulus being sized and shaped to substantially receive said ring whereby said clamping plate is adapted to clampingly engage said terminal plate, said plate having a lower serrated surface, the serrations being generally radial and including flats therebetween, said serrations flaring in width as they proceed outwardly from the central aperture of said plate and said serrations terminating short of the periphery of said clamping plate to provide a flat border.

* * * * *